US005862684A

United States Patent [19]

Park

[11] Patent Number: 5,862,684

[45] Date of Patent: Jan. 26, 1999

[54] WASHER HAVING SHOE CLEANING DEVICE

[75] Inventor: Joo Heum Park, Seoul, Rep. of Korea

[73] Assignee: Samsung Electronics Co., Ltd., Suwon, Rep. of Korea

[21] Appl. No.: 693,759

[22] Filed: Aug. 7, 1996

[30] Foreign Application Priority Data

Sep. 13, 1995 [KR] Rep. of Korea ..... 1995 29885

[51] Int. Cl.[6] ..... D06F 39/12

[52] U.S. Cl. ..... 68/4; 68/133; 68/134; 68/131; 15/37

[58] Field of Search ..... 68/4, 53, 131, 68/133, 134; 15/30, 32, 37

[56] References Cited

U.S. PATENT DOCUMENTS

| | | | |
|---|---|---|---|
| 1,838,595 | 12/1931 | Turner | 68/53 |
| 2,142,961 | 1/1939 | Kuhn | 68/134 |
| 2,167,147 | 7/1939 | Frantz | 68/4 |
| 3,922,890 | 12/1975 | Shibata | 68/4 |
| 4,435,964 | 3/1984 | Misawa | 15/37 |
| 5,421,174 | 6/1995 | Kim et al. | 68/134 |

FOREIGN PATENT DOCUMENTS

| | | | |
|---|---|---|---|
| 63-262195 | 10/1988 | Japan | 68/134 |
| 63-262196 | 10/1988 | Japan | 68/134 |
| 1-242093 | 9/1989 | Japan | 68/134 |

*Primary Examiner*—Frankie L. Stinson
*Attorney, Agent, or Firm*—Burns, Doane, Swecker & Mathis, L.L.P.

[57] ABSTRACT

A clothes washer includes a wash tub in which an agitator is mounted. The agitator includes a blade member which oscillates clockwise and counterclockwise about a vertical axis, a reciprocable member which oscillates with the blade member while reciprocating up-and-down, and a shoe cleaning device mounted on the reciprocable member for oscillation and vertical reciprocation therewith. The shoe cleaning device includes a circular plate carrying a plurality of brushes.

7 Claims, 4 Drawing Sheets

WASHER HAVING SHOE CLEANING DEVICE

BACKGROUND OF THE INVENTION

The present invention concerns a clothes washer having a shoe cleaning device.

A pulsation type agitator is typically mounted on the bottom of the washing tub, of a clothes washer enabling laundry to be agitated in alternative directions.

A Prior art washer having an agitator modified for improving the efficiency of washing is illustrated in FIG. 4. The washer comprises a water container 11 enclosed in a housing 10 for containing water, a washing basket 12 rotatably mounted in the water container 11, and an agitator 130 including a blade member 13 having a plurality of blades mounted on the bottom of the washing basket 12 and rotated in alternate directions. Mounted beneath the water container 11 are a motor 14 and a power transfer device 15 to rotate the agitator 130 and the washing basket 12. The power of the motor 14 is transferred through the shaft 17 of the power transfer device 15 to the agitator 1 and the washing basket 12. Also provided below the water container 11 is a discharge hose 16 for discharging the waste water out from the housing 10.

The agitator 130 includes the blade member 13 serving as a washboard, a member 31 rotating simultaneously with the rotating blade member 13, and a reciprocating member 41 moving in an up-and-down direction during rotation of the rotating member 31.

The agitator 130 has been already illustrated in detail in U.S. patent application Ser. No. 08/630,328, therefore, a detailed description of the agitator will be omitted.

In operation, cloths are put into the washing basket 12 and water into the water container 11, and then the motor 14 is supplied with power to be rotated. The force of the motor 14 is changed to a suitable washing speed by the power transfer device 15. Thus, the agitator 130 is rotated in an alternate manner so as to wash laundry in a water stream generated by the agitator 130. The water flow can cause serious twisting or entangling of the clothes, but the vertically reciprocating member 41 moves up and down to disturb the water flow, thus preventing clothes in the washer from twisting or entangling.

However, the conventional washer can not develop enough effect of washing for cleaning shoes. Normally, shoes are washed by hand or a brush. However, when washing shoes using a conventional washer, the cleaning condition is poor compared to using a conventional brush, because shoes are cleaned only by simple friction between water or the inner wall of a washing basket and the shoes.

SUMMARY OF THE INVENTION

It is an object of the present invention to provide a washer having a shoe cleaning device comprising a plurality of brushes oscillating with the washing blade member, for the efficiency of cleaning shoe.

According to the present invention, a washer comprises a water container mounted in a housing; an agitator mounted in the water container and providing a rotating blade member, and a reciprocating member moving in an up-and-down direction while oscillated by the blade member; a motor for rotating the agitator in alternative directions; and a shoe cleaning device mounted on the reciprocating means for providing a plurality of brushes.

Further, the shoe cleaning device is detachably mounted on the reciprocating member.

BRIEF DESCRIPTION OF THE DRAWINGS

The present invention will now be described in detail with reference to the accompanying drawings, in which.

DESCRIPTION OF A PREFERRED EMBODIMENT

Figure 1:
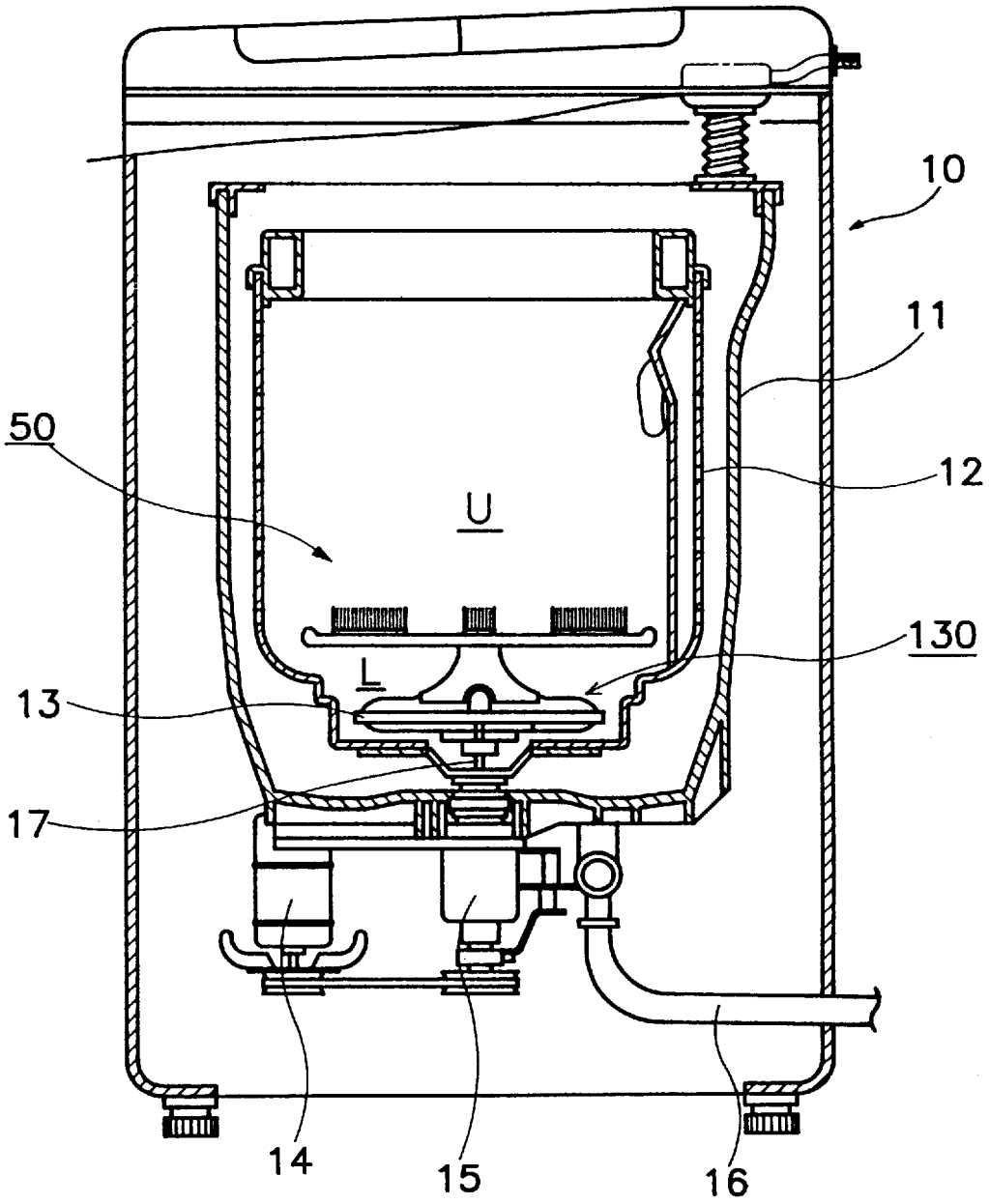
FIG. 1 is a vertical sectional view for illustrating a washer having a shoe cleaning device according to the present invention.
Figure 2:
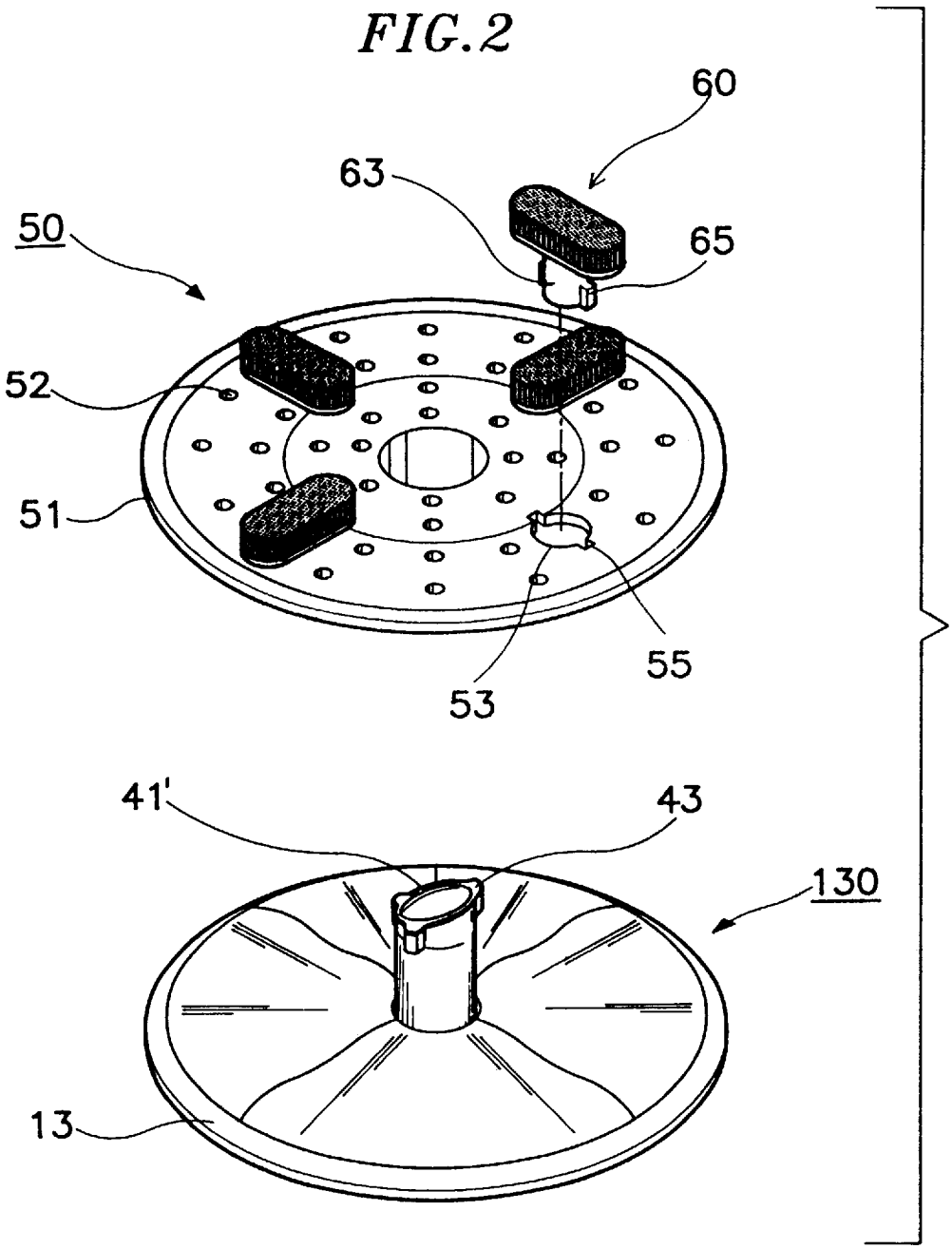
FIG. 2 is a perspective exploded view of the shoe cleaning device of FIG. 1.
Figure 3:
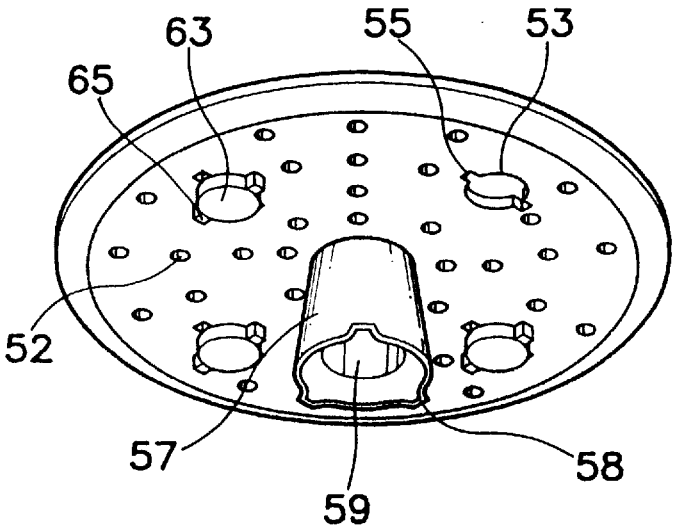
FIG. 3 is a bottom perspective view of the shoe cleaning device of FIG. 2.
Figure 4:
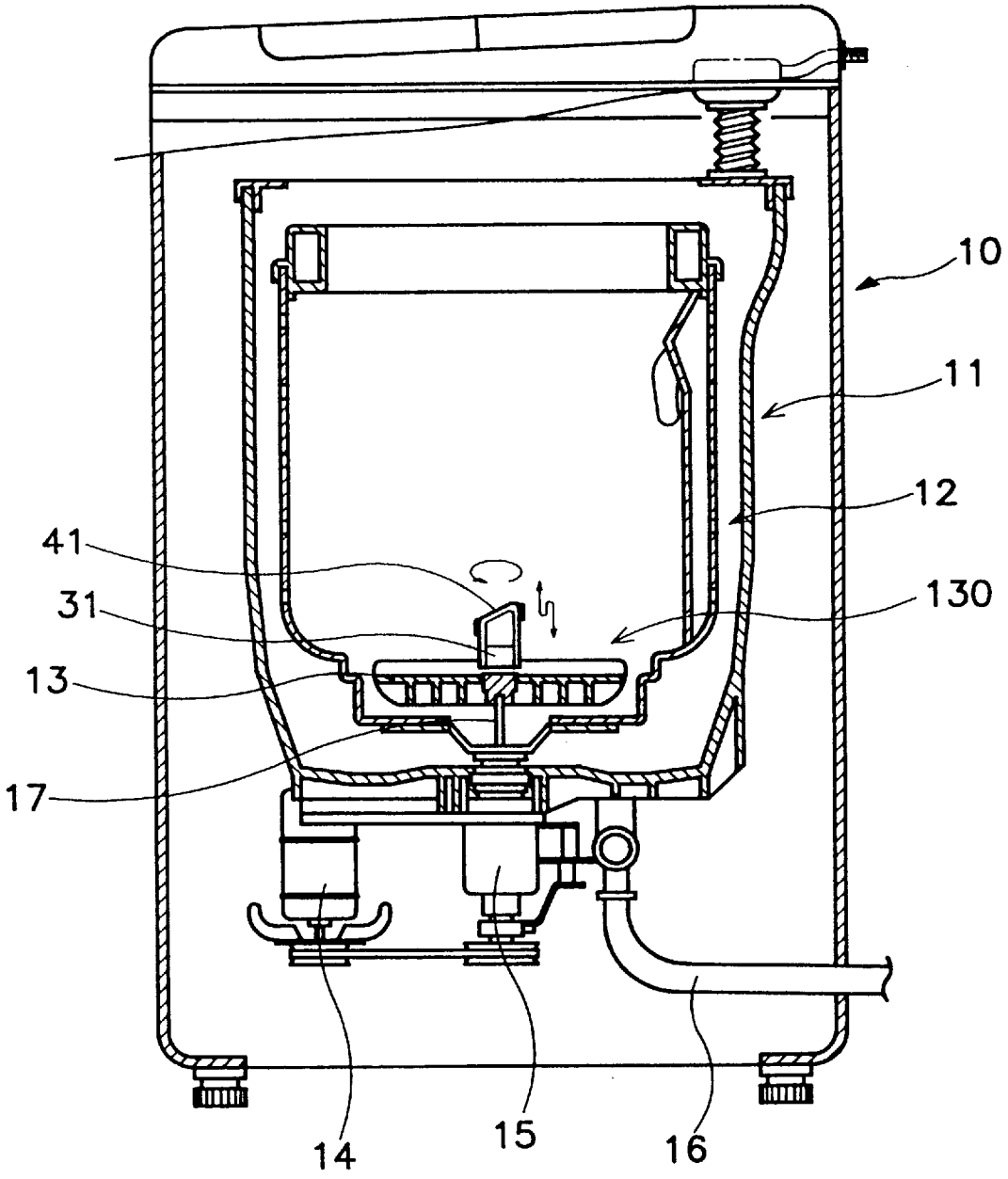
FIG. 4 (PRIOR ART)
FIG. 4 is a vertical sectional view for illustrating a washer according to the prior art.

FIG. 1 illustrates a washer having a shoe cleaning device. FIGS. 2 and 3 show the shoe cleaning device. The same components as in the prior art shown in FIG. 4 are designated by the same numerals. Thus, a detailed description of those parts will be omitted.

A shoe cleaning device 50 comprises a circular plate 51 and a plurality of brushes 60 detachably mounted on the circular plate 51 such that the brush bristles project upwardly. The circular plate 51 provides a plurality of thru-holes 52 through which water flows to the lower portion L of the washing basket 12 from the upper portion U of the washing basket 12 or vice versa. The circular plate 51 further has brush engaging holes 53 ( 4 in this embodiment ) occupied with brush members 63 of the brush 60 illustrated later.

Further, at the lower center portion of the circular plate 51 there is provided an engaging member 57 there which protrudes downwardly. In the engaging member 57 is provided an engaging cap 59 which is detachably placed on the reciprocating member 41' of the agitator 130 (see FIG. 4).

Furthermore, hooks 58 are formed on the periphery of the bottom portion of the engaging cap 59. The hooks 58 are assembled in a snap-in manner with corresponding protrusions 43 formed on the reciprocating member 41'. Thus, the shoe cleaning device 50 remains attached to the agitator 130 when in operation.

At the bottom portion of the brush 60 there is provided the brush mounting member 63 which is fitted into the brush engaging hole 53 of the circular plate 51. Further, two projections 65 are provided on the peripheral lower portion of the brush mounting member 63. The brush engaging hole 53 is provided with recesses 55 that are complementary to the projections 65. Therefore, if the brush 60 is assembled to the circular plate 51, the brush mounting member 63 having the projections 65 is passed through the brush engaging hole 53 and the recesses 55. After that, the brush 60 is turned in a predetermined angle whereby the brush 61 can not arbitrarily be separated from the circular plate 51 during the operation of the shoe cleaning device 50.

The operation of the washer having the shoe cleaning device 50 is as follows:

In the shoe cleaning mode, firstly the shoe cleaning device 50 is placed on the reciprocating member 41 of the agitator 130 by snapping the hooks 58 of the engaging member 57 onto the protrusions 43 of the reciprocating member 41, the circular plate 51 is pushed toward the agitator 130. After the assembly of the hooks 58 and the protrusions 43, the shoe cleaning device 50 rotates with the reciprocating member 41.

After loading the shoes into the washing basket 12 and filling the water container 11 with water, electricity is supplied to the motor 14. The oscillating drive of the motor 14 is transmitted to the agitator 130 through the power transfer device 15 at a lower speed proper for cleaning shoes, rotating the agitator 130 in alternate directions. The lower speed rotation of the agitator 130 prevents the shoes from being damaged, caused by excessive abrasion between the shoes and the brushes the swirling water stream when at the high speed rotation. The reciprocating member 41 is rotated and moved in an up-and-down direction during the oscillation of the blade member. Simultaneously, the shoe cleaning device 50 fitted on the reciprocating member 41 is rotated and moved in an up-and-down direction therewith.

The water force applied to the circular plate 51, which is generated by the up-and-down movement of the plate 51, is decreased by the plurality of thru-holes 52. That is, in the downward movement of the plate 51 the water in the lower portion L of the washing basket 12 is directed to the upper portion U through the thru-holes 52 while in the upward movement of the plate 51 the water in the upper portion U of the washing basket 12 is directed to the lower portion L through the thru-holes 52. Shoes are cleaned during the rotation and the up-and-down movement of the shoe cleaning device 50. Additionally, water in the basket 12 is at a first, lower level during the shoe cleaning mode while being at a higher level during the shoe rinsing mode, increasing the efficiency of cleaning the shoes.

Next, in the laundry washing mode, the protrusions 43 of the reciprocating member 41 are released from the hooks 58 of the engaging member 57, and the shoe cleaning device 50 is taken out from the washing basket 12. In this stage, laundry is washed by the up-and-down movement of the reciprocation member 41 as well as the rotation of the blade member 13. If a brush 60 is damaged when the shoe cleaning device 50 is taken from the washing basket 12, the brush 60 is turned by hand. The projection 65 of the brush mounting member 63 become aligned with the recesses 55 of the brush engaging hole 53 and next the brush 60 is removed from the circular plate 51. On the other hand, the brush mounting member 63 of a new brush is passed through the brush engaging hole 53 of the circular plate 51 and the brush is turned to a predetermined angle. Accordingly, the projections 65 of the brush 60 underlie the bottom surface of the circular plate 51, completing the attachment of the brush 60 to the circular plate 51.

As described above, the washer having a shoe cleaning device has the increased efficiency of washing so that, as the reciprocating member of the agitator is moved in an up-and-down manner, a swirling stream is generated to increase the movement of the shoes.

Further, since the moving range of the brush attached on the shoe cleaning device is enlarged due to the additional vertical movement of the device, the rubbing action against the shoes is increased.

Furthermore, the reliability of the shoe cleaning device is increased so that if a brush is damaged it can be immediately replaced since the brush is designed to be replaceable.

What is claimed is:

1. A clothes washer comprising:

a housing;

a water container mounted in the housing;

a motor-driven agitator mounted in the water container and including:

an oscillatable blade member mounted for oscillation about a vertical axis, a vertically reciprocable member mounted on the blade member for up-and-down reciprocation while oscillating with the blade member, and a shoe cleaning device, including shoe-cleaning brushes, mounted on the reciprocable member for oscillation and up-and-down movement therewith, wherein the shoe cleaning device is removable from the blade member and comprises a circular plate on which the brushes are mounted, the circular plate including a downwardly projecting connecting member connectible with the reciprocable member.

2. The clothes washer according to claim 1 wherein the circular plate has through-holes to facilitate vertical reciprocation thereof within wash water.

3. The clothes washer according to claim 1 wherein the connecting member includes hooks, and the reciprocable member includes protrusions for receiving respective ones of the hooks.

4. The clothes washer according to claim 1 wherein the brushes are removably mounted on the plate.

5. The clothes washer according to claim 1 wherein each brush includes a downwardly extending brush-mounting member receivable in a respective brush engaging hole of the plate.

6. The clothes washer according to claim 5 wherein each brush mounting member includes projections that are slidable through respective recesses formed in an edge of the brush-engaging hole.

7. The clothes washer according to claim 1 wherein the brushes have upwardly projecting bristles.

* * * * *